US009022519B2

(12) United States Patent
Umetsu et al.

(10) Patent No.: US 9,022,519 B2
(45) Date of Patent: May 5, 2015

(54) PRINTING DEVICE

(71) Applicant: Seiko Epson Corporation, Tokyo (JP)

(72) Inventors: Hiroshi Umetsu, Nagano (JP); Yoshitake Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/259,654

(22) Filed: Apr. 23, 2014

(65) Prior Publication Data

US 2014/0232774 A1 Aug. 21, 2014

Related U.S. Application Data

(62) Division of application No. 13/412,769, filed on Mar. 6, 2012, now Pat. No. 8,740,340.

(30) Foreign Application Priority Data

Mar. 9, 2011 (JP) ..... 2011-051319
Mar. 15, 2011 (JP) ..... 2011-056897

(51) Int. Cl.

| | |
|---|---|
| ***B41J 2/01*** | (2006.01) |
| ***B41J 29/38*** | (2006.01) |
| ***B41J 2/045*** | (2006.01) |
| ***B41J 2/21*** | (2006.01) |
| ***B41J 3/407*** | (2006.01) |
| ***B41J 11/46*** | (2006.01) |
| ***B41J 11/42*** | (2006.01) |

(52) U.S. Cl.

CPC ..... *B41J 2/04505* (2013.01); *B41J 2/2142* (2013.01); *B41J 3/407* (2013.01); *B41J 11/46* (2013.01); *B41J 11/42* (2013.01)

USPC ..... 347/19; 347/16; 347/101

(58) Field of Classification Search

CPC ..... B41J 2/04505
USPC ..... 347/16, 19, 101
See application file for complete search history.

(56) References Cited

U.S. PATENT DOCUMENTS

| | | | | |
|---|---|---|---|---|
| 5,737,441 | A | 4/1998 | Nishi | |
| 2003/0189606 | A1 | 10/2003 | Moon et al. | |
| 2004/0252153 | A1 | 12/2004 | Moon et al. | |
| 2006/0050102 | A1 | 3/2006 | Kojima | |
| 2006/0068083 | A1 | 3/2006 | Moon et al. | |
| 2009/0085957 | A1 | 4/2009 | Fujimori | |
| 2009/0141060 | A1* | 6/2009 | Kwon et al. | 347/14 |
| 2009/0304916 | A1* | 12/2009 | Nakajima et al. | 427/140 |
| 2009/0315941 | A1* | 12/2009 | Kojima | 347/22 |
| 2010/0259736 | A1 | 10/2010 | Kinjo et al. | |

FOREIGN PATENT DOCUMENTS

| | | | |
|---|---|---|---|
| JP | 08-306763 | A | 11/1996 |
| JP | 2000-292132 | A | 10/2000 |
| JP | 2001-044601 | A | 2/2001 |
| JP | 2003-080687 | A | 3/2003 |
| JP | 2003-303544 | A | 10/2003 |

(Continued)

*Primary Examiner* — Jason Uhlenhake
(74) *Attorney, Agent, or Firm* — Global IP Counselors, LLP

(57) ABSTRACT

A printing device includes a camera position control mechanism configured and arranged to control a position of the camera to switch between a first state in which the alignment mark is photographed from a side of the first face, and a second state in which the alignment mark is photographed from a side of the second face.

5 Claims, 11 Drawing Sheets

(56) References Cited

FOREIGN PATENT DOCUMENTS

| | | | |
|---|---|---|---|
| JP | 2005-172686 | A | 6/2005 |
| JP | 2006-076067 | A | 3/2006 |
| JP | 2006-114807 | A | 4/2006 |
| JP | 2006-294969 | A | 10/2006 |
| JP | 2007-240264 | A | 9/2007 |
| JP | 2008-053624 | A | 3/2008 |
| JP | 2008-171873 | A | 7/2008 |
| JP | 2010-069707 | A | 4/2010 |

* cited by examiner

PRINTING DEVICE

CROSS-REFERENCE TO RELATED APPLICATIONS

This application is a divisional application of U.S. patent application Ser. No. 13/412,769 filed on Mar. 6, 2012. This application claims priority to Japanese Patent Application No. 2011-051319 filed on Mar. 9, 2011 and Japanese Patent Application No. 2011-056897 filed on Mar. 15, 2011. The entire disclosures of U.S. patent application Ser. No. 14/412,769 and Japanese Patent Application Nos. 2011-051319 and 2011-056897 are hereby incorporated herein by reference.

BACKGROUND

1. Technical Field

The present invention relates to a printing device.

2. Related Art

In recent years, a technique has been proposed for coating a recording medium using an ink jet method for dropletizing and discharging a functional liquid, and printing predetermined information on the recording information by solidifying the coated functional liquid. Japanese Laid-Open Patent Application 2003-80687 discloses a printing device for using an IC chip as a recording medium and printing a serial number, manufacturing company, or other predetermined information on the IC chip.

In cases in which printing is performed by an inkjet method like that discussed above, alignment of the recording medium, the inkjet head, and the medium-retaining stage is necessary for the functional liquid from the inkjet head to land accurately on the recording medium. For this reason, the surface of the recording medium is typically furnished with alignment marks. In cases of performing this sort of alignment, the alignment marks furnished to the recording medium are photographed by a camera, and the position of the recording medium is then adjusted to a desired location by calculating the position of the recording medium based on the alignment marks.

Sometimes, alignment marks are furnished on both the front planar side and back planar side of the recording medium, as shown in Japanese Laid-Open Patent Application 2008-171873, for example. In this case, the configuration would be provided with a plurality of cameras in order to photograph the alignment marks on both sides. Because this configuration is provided with a plurality of cameras, even in cases in which, for example, alignment marks are furnished to either face of the recording medium, it is possible to photograph the alignment marks in a reliable manner nevertheless.

Furthermore, in cases of ejecting a functional liquid from an inkjet head in the manner discussed previously, in order to obtain good recorded image quality, a nozzle dropout test is performed to determine whether or not the functional liquid has been sprayed in a satisfactory manner from the nozzles of the inkjet head (see Japanese Laid-Open Patent Application 2006-76067, for example). The nozzle dropout test involves photographing the functional liquid with the camera as it is sprayed onto a test area from the nozzles to detect the condition of ejection of the functional liquid from each nozzle, and then determining nozzle dropout based on the detected result.

Accordingly, in printing by the inkjet method discussed previously, it would be desirable for the printing device to be able to perform both alignment and nozzle dropout testing.

SUMMARY

However, in cases in which a plurality of cameras are provided for alignment purposes as taught in the prior art discussed above, or in cases in which there is a need for both an alignment camera and a nozzle dropout camera in order to handle alignment and nozzle dropout testing, increased size of the printing device, or higher cost of the printing device per se, can be a problem.

With the foregoing in view, it is an object of the present invention to provide a printing device that is able to photograph an alignment mark with a single camera, regardless of which face of a substrate resting on a stage is furnished with the alignment mark.

Another object of the present invention is to provide a printing device whereby the alignment process and nozzle dropout testing can be performed with a single camera, so as to realize a device configuration that is smaller and cheaper.

In order to solve the aforedescribed problems, a printing device according to one aspect of the present invention includes a stage, a camera, and a camera position control mechanism. The stage is configured and arranged to support a substrate onto which droplets of liquid are ejected from nozzles of an ejection head. The camera is configured and arranged to photograph an alignment mark furnished to one of a first face and a second face of the substrate. The camera position control mechanism is configured and arranged to control a position of the camera to switch between a first state in which the alignment mark is photographed from a side of the first face, and a second state in which the alignment mark is photographed from a side of the second face.

According to the printing device of the above described aspect of the present invention, the camera position control mechanism can control the position of the camera so as to enable switching between a first state in which the substrate is photographed from one side, and a second state in which the substrate is photographed from the other side. Therefore, the camera position control mechanism can photograph an alignment mark on the one side of the substrate by controlling the camera to the first state position. The camera position control mechanism can photograph an alignment mark on the other side of the substrate by controlling the camera to the second state position. Consequently, the alignment mark can be photographed with a single camera regardless of which face of the substrate resting on a stage has been furnished with the alignment mark. Thus, it is unnecessary to provide a plurality of cameras, and therefore increased size of the device configuration can be prevented, and higher cost of the printing device can be prevented.

In the aforedescribed printing device, the stage includes a through-hole formed in an area in which the substrate rests on the stage such that the alignment mark furnished on the second face faces an inner side of the through-hole.

According to this configuration, in the second state, alignment mark photographing of the alignment mark furnished on the other face can take place in a reliable manner via the through-hole formed in the area of the stage on which the substrate rests.

The aforedescribed printing device preferably further includes an input section configured and arranged to input information indicating which of the first and second faces of the substrate is furnished with the alignment mark. The camera position control mechanism is preferably configured and arranged to switch the position of the camera in response to input of the input section.

According to this configuration, the camera position can be reliably switched to an optimum position, in response to input of the input section.

The aforedescribed printing device preferably further includes an identifier section configured and arranged to identify which of the first and second faces of the substrate is furnished with the alignment mark. The camera position control mechanism is preferably configured and arranged to switch the position of the camera in response to an identification result of the identifier section.

According to this configuration, the camera position can be reliably switched to an optimum position, in response to an identification result of the identifier section.

In the aforedescribed printing device, the camera position control mechanism is preferably configured and arranged to photograph with the camera in one of the first state and the second state, and to switch the position of the camera to the other of the first state and the second state and to photograph with the camera when the alignment mark furnished to the substrate cannot be photographed in the one of the first state and the second state.

According to this configuration, based on the state in which the camera photographed the alignment mark, it is possible to distinguish which face of the substrate has been furnished with alignment mark.

A printing device according to another aspect of the present invention includes a stage, a supporting section, a camera and a camera position control mechanism. The stage is configured and arranged to support a substrate onto which droplets of liquid are ejected from nozzles of an ejection head. The supporting section is configured and arranged to support a liquid landing member on which droplets ejected from the nozzles of the ejection head are caused to land. The camera is configured and arranged to photograph an alignment mark furnished to the substrate, or to photograph a face of the liquid landing member on which the liquid lands. The camera position control mechanism is configured and arranged to control a position of the camera to switch between a first state enabling photographing of the alignment mark, and a third state enabling photographing of the face of the liquid landing member on which the liquid lands.

According to the printing device of the above described aspect of the present invention, the camera position control mechanism can control the position of the camera so as to enable switching between a first state for photographing an alignment mark, and a third state for photographing the face of the liquid landing member on which the liquid lands. Thus, the substrate alignment process and nozzle state testing can be performed with a single camera, to realize a multifunctional printing device having fewer parts as well, so that the device configuration can be smaller and cheaper.

The aforedescribed printing device preferably further includes a nozzle dropout determining section configured and arranged to determine a state of the nozzles of the ejection head based on a result of photographing by the camera of the face of the liquid landing member on which the liquid lands.

According to this configuration, the state of the nozzles of the ejection head can be satisfactorily ascertained by the nozzle dropout determining section, whereby the nozzles can always be kept in a satisfactory state, and a highly reliable device with high print quality can be afforded.

In the aforedescribed printing device, the liquid landing member preferably includes a sheet member that moves together with the stage, with respect to the ejection head.

According to this configuration, because the liquid landing member moves together with the stage with respect to the ejection head, the sheet member can move to below the ejection head. Therefore, liquid can be ejected onto the sheet member from all of the nozzles of the ejection head.

In the aforedescribed printing device, in the first state, the camera is preferably configured and arranged to photograph the alignment mark furnished to a back face of the substrate via a through-hole formed in the stage.

According to this configuration, the camera can reliably photograph an alignment mark furnished to the back side of the substrate.

BRIEF DESCRIPTION OF THE DRAWINGS

Referring now to the attached drawings which form a part of this original disclosure.

DETAILED DESCRIPTION OF EXEMPLARY EMBODIMENTS

The following is a description of modes for carrying out the printing device of the present invention, with reference to the accompanying drawings.

The following embodiment of implementation is meant to illustrate one aspect of the present invention and not to limit the present invention; any desired change to the present invention within the technical scope of the spirit thereof is possible. Also, to facilitate understanding of each of the configurations, the following drawings have different scales, numbers, and other parameters for each of the structures from the actual structures.

An example of a printing device and of a printing method for printing by using the printing device to discharge droplets, being features of the present invention, shall be described in this embodiment with reference to FIGS. 1 to 9.

Semiconductor Substrate

First, a semiconductor substrate, which is an example of an object to be drawn (printed) on with a printing device, shall now be described.

Figure 1A:
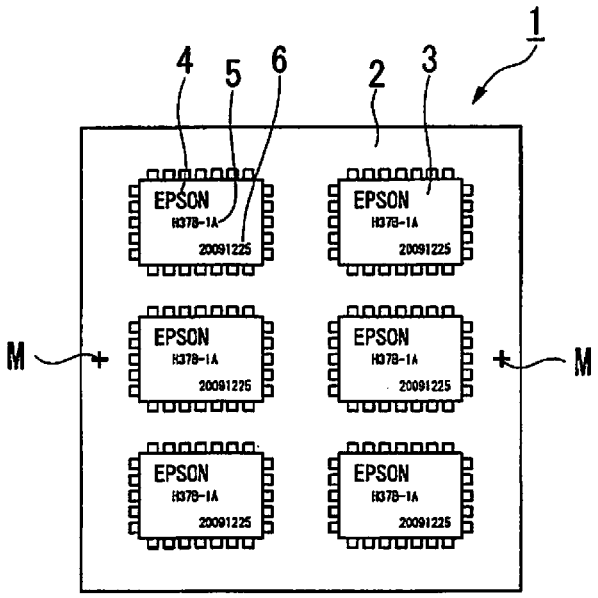
FIG. 1A is a schematic plan view showing a semiconductor substrate.

FIG. 1A is a schematic plan view illustrating a semiconductor substrate. As illustrated in FIG. 1A, a semiconductor substrate 1 serving as a base material is provided with a substrate 2. The substrate 2 may be heat-resistant and may allow for the installation of a semiconductor device 3; a glass epoxy substrate, phenolic paper substrate, epoxy paper substrate, or the like can be used as the substrate 2.

The semiconductor device 3 is installed onto the substrate 2. A company name mark 4, a model code 5, a serial number 6, and other marks (printing patterns or predetermined patterns) are drawn on the semiconductor device 3. These marks are drawn on by the printing device. These marks are therefore drawn onto the mold layer formed on the surface of the semiconductor device 3.

The semiconductor substrate 1 is furnished on one face thereof, in the present embodiment, the front face 1*a* side, with alignment marks M. These alignment marks M are used during an alignment step with respect to the stage of a coating section, to be discussed later.

Printing Device

Figure 1B:
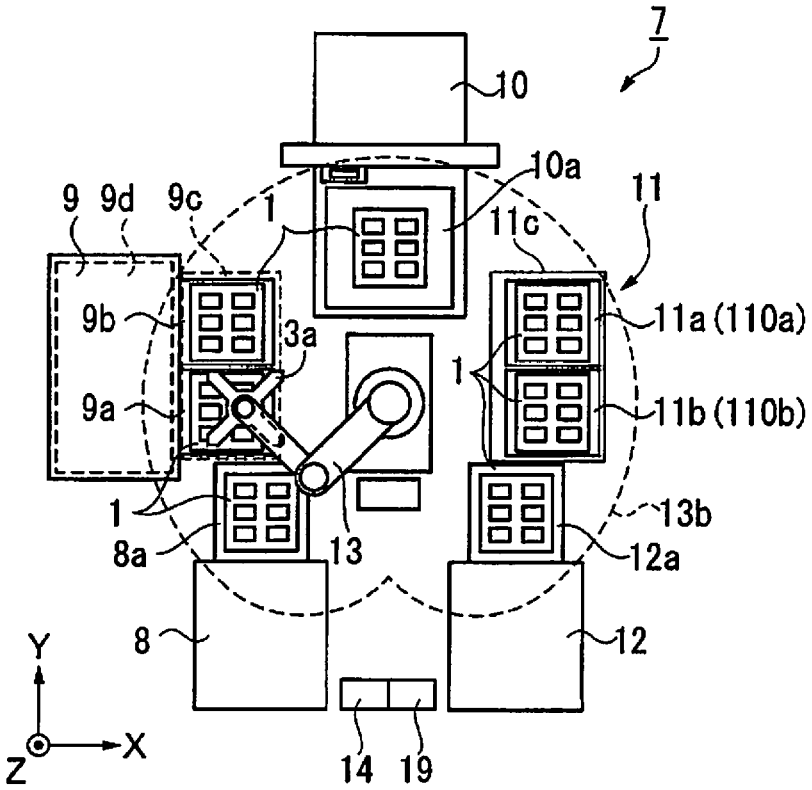
FIG. 1B is a schematic plan view showing a drop ejection device.

FIG. 1B is a schematic plan view illustrating a printing device.

As illustrated in FIG. 1B, a printing device 7 is primarily constituted of a supply section 8, a pre-treatment section 9, a coating section (printing section) 10, a cooling section 11, a storage receptacle 12, a transport section 13, and a controller 14. The printing device 7 has the supply section 8, the pre-treatment section 9, the coating section 10, the cooling section 11, the storage receptacle 12, the controller 14, and the input section 19 disposed, in the stated order, clockwise around the transport section 13. The supply section 8 is also disposed adjacent to the controller 14. The direction in which the supply section 8, the controller 14, and the storage receptacle 12 form a line serves as an X direction. The direction orthogonal to the X direction serves as a Y direction; the coating section 10, the transport section 13, and the controller 14 are disposed lined up in the Y direction. The vertical direction serves as a Z direction.

The supply section 8 is provided with a storage receptacle in which a plurality of semiconductor substrates 1 are housed. The supply section 8 is also provided with a relay point 8*a*, the semiconductor substrates 1 being supplied to the relay point 8*a* from the storage receptacle.

The pre-treatment section 9 has the function of modifying while also heating the surface of the semiconductor device 3. The spreading conditions of the discharged droplets and the close adhesion of the printed marks are adjusted on the semiconductor device 3 by the pre-treatment section 9. The pre-treatment section 9 is provided with a first relay point 9*a* and a second relay point 9*b*, and takes in the pre-treatment semiconductor substrate 1 from the first relay point 9*a* or the second relay point 9*b* and modifies the surface. Thereafter, the pre-treatment section 9 moves the post-treatment semiconductor substrate 1 to either the first relay point 9*a* or the second relay point 9*b*, and places the semiconductor substrate 1 on standby. The first relay point 9*a* and the second relay point 9*b* are combined to make a relay point 9*c*. When pre-treatment is being performed within the pre-treatment section 9, the point at which the semiconductor substrate 1 is located is a treatment point 9*d*.

The cooling section 11 has a function of cooling the semiconductor substrates 1, once heating and surface modification have been performed in the pretreatment section 9. The cooling section 11 has treatment locations 11*a*, 11*b* where the semiconductor substrates 1 are respectively held and cooled. For convenience, the treatment locations 11*a*, 11*b* are sometimes referred to collectively as treatment locations 11*c*.

The coating section 10 discharges droplets onto the semiconductor device 3 to draw (print) a mark, and has a function for either solidifying or curing the mark having been drawn. The coating section 10 is provided with a relay point 10*a*, and moves the pre-drawing semiconductor substrate 1 from the relay point 10*a* to perform a drawing treatment and a curing treatment. Thereafter, the coating section 10 moves the post-drawing semiconductor substrate 1 to the relay point 10*a*, and places the semiconductor substrate 1 on standby.

The storage receptacle 12 is provided with a storage receptacle capable of housing a plurality of semiconductor substrates 1. The storage receptacle 12 is also provided with a relay point 12*a*, and houses the semiconductor substrate 1 in the storage receptacle from the relay point 12*a*. An operator discharges, from the printing device 7, the storage receptacle in which the semiconductor substrates 1 are housed.

The input section 19 is adapted to receive user input of printing parameters (printed image quality, number of substrates to be printed, etc.) for the semiconductor substrates 1, and includes, for example, a touch panel for the user to input desired information to the controller 14 by touching the screen. In the present embodiment, via the input section 19, the user is able to input information regarding the face e of the semiconductor substrate 1 on the side thereof furnished with the alignment marks M. The input section 19 is electrically connected to the controller 14, and transmits information input by the user to the controller 14.

The transport section 13 is arranged at a point in the middle of the printing device 7. A scalar-type robot provided with two arm parts is used as the transport section 13. Grasping sections 13*a* for gripping the semiconductor substrate 1 are installed at the tips of the arm parts. The relay points 8*a*, 9*c*, 10*a*, 12*a* are located inside a moving range 13*b* of the grasping sections 13*a*. Accordingly, the grasping sections 13*a* are able to move the semiconductor substrate 1 between the relay points 8*a*, 9*c*, 10*a*, 12*c*. The controller 14 is a device for controlling the operation of the entire printing device 7, and manages the operating status of each of the parts of the printing device 7. An instruction signal for moving the semiconductor substrate 1 is outputted to the transport section 13. The semiconductor substrate 1 is thereby made to pass through each of the parts in sequence and be drawn on.

The following is a more detailed description of each of the parts.

Supply Section

Figure 2A:
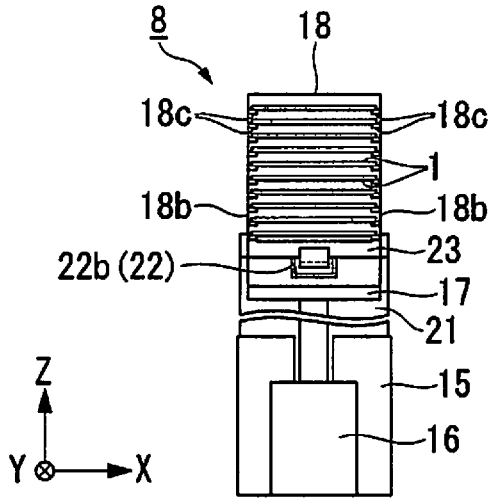
FIGS. 2A to 2C are schematic views showing a supply section.
Figure 2B:
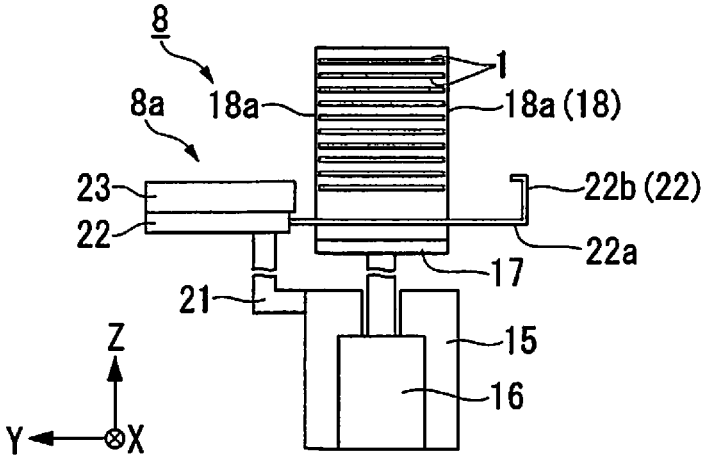
Figure 2C:
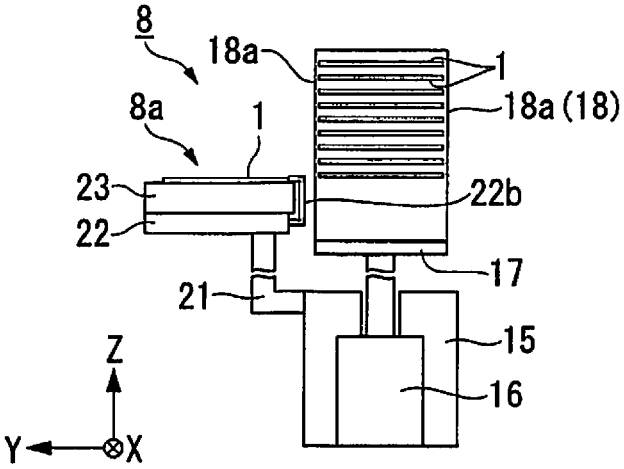

FIG. 2A is a schematic front view illustrating the supply section, and FIGS. 2B and 2C are schematic side views illustrating the supply section. As illustrated in FIGS. 2A and 2B, the supply section 8 is provided with a base stage 15. A vertical motion device 16 is installed inside the base stage 15. The vertical motion device 16 is provided with a linear movement mechanism for operating in the Z direction. As the linear movement mechanism, it is possible to use a combination of a ball screw and a rotary motor, a combination of a hydraulic cylinder and an oil pump, or other mechanism. This embodiment employs a mechanism which operates by a ball screw and a step motor, by way of example. A vertical movement plate 17 is installed on the upper side of the base stage 15 so as to be in contact with the vertical motion device 16. The vertical movement plate 17 can be moved vertically by the vertical motion device 16 only by a predetermined degree of travel.

A cuboid storage receptacle 18 is installed on top of the vertical movement plate 17, a plurality of semiconductor substrates 1 being housed within the storage receptacle 18. The storage receptacle 18 has opening parts 18*a* formed on both surfaces in the Y direction, allowing for the removal and insertion of the semiconductor substrate 1 from the opening parts 18*a*. Convex rails 18*c* are formed inside side surfaces 18*b* located on both sides of the X direction of the storage receptacle 18, the rails 18*c* being arranged so as to extend in the Y direction. The rails 18*c* are arrayed in a plurality of equally spaced intervals in the Z direction. The semiconductor substrates 1 are inserted from either the Y direction or the −Y direction along the rails 18*c*, whereby the semiconductor substrates 1 are housed in an array in the Z direction.

A substrate withdrawer 22 and a relay stage 23 are installed via a supporter material 21 in the Y direction side of the base stage 15. The relay stage 23 is arranged so as to overlap the substrate withdrawer 22 in the case of the Y direction side of the storage receptacle 18. The substrate withdrawer 22 is provided with an arm part 22*a* which stretches in the Y direction, and a linear movement mechanism for driving the arm part 22*a*. The linear movement mechanism is not particularly limited, provided that the linear movement mechanism be a mechanism for moving in a linear manner; the present embodiment employs an air cylinder operated by compressed air, by way of example. A claw part 22*b* bent in a substantially rectangular manner is installed at one end of the arm part 22*a*, the tip of the claw part 22*b* being formed so as to be parallel with the arm part 22*a*.

The substrate withdrawer 22 stretches the arm part 22*a*, whereby the arm part 22*a* penetrates the storage receptacle 18. Then, the claw part 22*b* moves to the −Y direction side of the storage receptacle 18. Next, after the vertical motion device 16 lowers the semiconductor substrate 1, the substrate withdrawer 22 contracts the arm part 22*a*. At such a time, the claw part 22*b* moves while pushing one end of the semiconductor substrate 1.

As a result, as illustrated in FIG. 2C, the semiconductor substrate 1 is made to move over the relay stage 23 from the storage receptacle 18. The relay stage 23 has a concave part formed to have substantially the same width as the width in the X direction of the semiconductor substrate 1, the semiconductor substrate 1 being moved along the concave part. The position in the X direction of the semiconductor substrate 1 is determined by the concave part. The position in the Y direction of the semiconductor substrate 1 is determined by the point where the semiconductor substrate 1 is halted, pushed by the claw part 22*b*. The relay point 8*a* is on top of the relay stage 23, and the semiconductor substrate 1 is put on standby at a predetermined point of the relay point 8*a*. When the semiconductor substrate 1 is put on standby at the relay point 8*a* of the supply section 8, the transport section 13 moves the grasping section 13*a* to the point facing opposite the semiconductor substrate 1 and moves gripping the semiconductor substrate 1.

After the semiconductor substrate 1 is moved from above the relay stage 23 by the transport section 13, the substrate withdrawer 22 stretches out the arm part 22*a*. Next, the vertical motion device 16 lowers the storage receptacle 18, and the substrate withdrawer 22 moves the semiconductor substrate 1 over the relay stage 23 from within the storage receptacle 18. In this manner, the supply section 8 moves the semiconductor substrates 1 in sequence from the storage receptacle 18 onto the relay stage 23. After all of the semiconductor substrates 1 within the storage receptacle 18 have been moved onto the relay stage 23, the operator switches the storage receptacle 18, which is now empty, with a storage receptacle 18 in which semiconductor substrates 1 are housed. The semiconductor substrates can thereby be supplied to the supply section 8.

Pre-Treatment Section

Figure 3A:
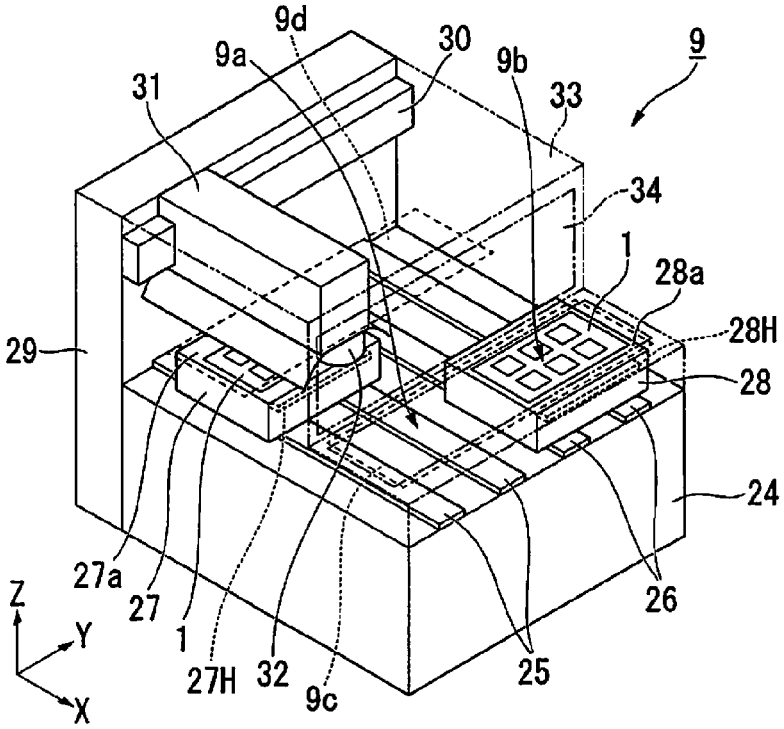
FIGS. 3A and 3B are simplified perspective views showing the configuration of a pretreatment section.
Figure 3B:
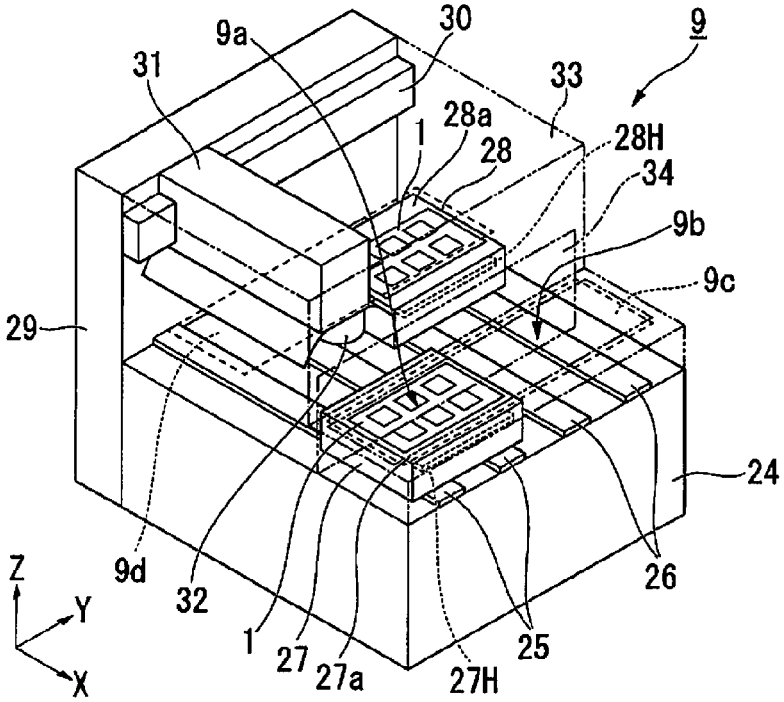

FIGS. 3A and 3B are schematic perspective views illustrating the configuration of the pre-treatment section. As illustrated in FIG. 3A, a pre-treatment section 9 is provided with a base stage 24, and a pair of a first guide rail 25 and a second guide rail 26 are installed in a series each extending in the X direction on the base stage 24. A first stage 27 serving as a mounting stage which moves reciprocatingly in the X direction along the first guide rail 25 is installed on the first guide rail 25, and a second stage 28 serving as a mounting stage which moves reciprocatingly in the X direction along the second guide rail 26 is installed on the second guide rail 26. The first stage 27 and the second stage 28 are provided with a linear movement mechanism and are able to move reciprocatingly. As the linear movement mechanism, it is possible to use, for example, a mechanism similar to the linear movement mechanism provided to the vertical motion device 16.

A mounting surface 27*a* is installed on the upper surface of the first stage 27, and a suction-type chucking mechanism is formed on the mounting surface 27*a*. The transport section 13 mounts the semiconductor substrate 1 onto the mounting surface 27*a* and thereafter causes the chucking mechanism to operate, whereby the pre-treatment section 9 is able to secure the semiconductor substrate 1 to the mounting surface 27*a*. Similarly, a mounting surface 28*a* is also installed on the upper surface of the second stage 28, and a suction-type chucking mechanism is formed on the mounting surface 28*a*. The transport section 13 mounts the semiconductor substrate 1 onto the mounting surface 28*a* and thereafter causes the chucking mechanism to operate, whereby the pre-treatment section 9 is able to secure the semiconductor substrate 1 to the mounting surface 28*a*.

A heating device 27H is built into the first stage 27, and heats the semiconductor substrate 1, having been mounted onto the mounting surface 27*a*, to a predetermined temperature while being controlled by the controller 14. Similarly, a heating device 28H is built into the second stage 28, and heats the semiconductor substrate 1, having been mounted onto the mounting surface 28*a*, to a predetermined temperature while being controlled by the controller 14.

A point on the mounting surface 27*a* when the first stage 27 is arranged on the X direction side serves as a first relay point 9*a*, and a point on the mounting surface 28*a* when the second stage 28 is arranged on the X direction side serves as a second relay point 9*b*. A relay point 9*c*, being the first relay point 9*a* and the second relay point 9*b*, is positioned within the operating range of the grasping sections 13*a*; the mounting surface 27*a* and the mounting surface 28*a* are exposed at the relay point 9*c*. Accordingly, the transport section 13 is readily able to mount the semiconductor substrate 1 onto the mounting surface 27*a* and the mounting surface 28*a*. After the semiconductor substrate 1 has been pre-treated, the semiconductor substrate 1 is put on standby over the mounting surface 27*a* positioned at the first relay point 9*a* or over the mounting surface 28*a* positioned at the second relay point 9*b*. Accordingly, the grasping sections 13*a* of the transport section 13 are readily able to move gripping the semiconductor substrate 1.

A planar support section 29 is assembled in the −X direction of the base stage 24. A guide rail 30 extending in the Y direction is installed on the upper side on the surface in the X direction side of the support section 29. Also, a carriage 31 which moves along the guide rail 30 is installed at a point facing opposite the guide rail 30. The carriage 31 is provided with a linear movement mechanism, and is able to move reciprocatingly. As the linear movement mechanism, it is possible to use, for example, a mechanism similar to the linear movement mechanism provided to the vertical motion device 16.

A treatment section 32 is installed at the base stage 24 side of the carriage 31. Illustrative examples of the treatment section 32 can include a low-pressure mercury lamp for emitting activation light rays, a hydrogen burner, an excimer laser, plasma discharge section, corona discharge section, or the like. In the case where a mercury lamp is used, the semiconductor substrate 1 is irradiated with ultraviolet light, whereby the liquid repellency of the surface of the semiconductor substrate 1 can be modified. In the case where a hydrogen burner is used, the oxidized surface of the semiconductor surface 1 can be partially reduced, the surface being thus roughened. In the case where an excimer laser is used, the surface of the semiconductor substrate 1 can be partially molten and solidified, and is thus roughened. In the case where plasma discharge or corona discharge is used, the surface of the semiconductor substrate 1 can be mechanically ground, and is thus roughened. The present embodiment employs a mercury lamp, by way of example. The pretreatment section 9 brings about reciprocating motion of the carriage 31 while the semiconductor substrate 1, in a state of being heated by the heating devices 27H, 28H, is being irradiated with ultraviolet from the treatment section 32. In so doing, it is possible for the pretreatment section 9 to irradiate a wide area of the treatment location 9*d* with ultraviolet.

The pre-treatment section 9 is entirely covered by an outer covering part 33. A door part 34 which can move up and down is installed in the interior of the outer covering part 33. Also, as illustrated by FIG. 3B, the door part 34 is lowered after the first stage 27 or the second stage 28 has moved to a point facing opposite the carriage 31. The ultraviolet light irradiated by the treatment section 32 is thereby prevented from leaking outside of the pre-treatment section 9.

When either the mounting surface 27*a* or the mounting surface 28*a* is located at the relay point 9*c*, the transport section feeds the semiconductor substrate 1 to the mounting surface 27*a* and the mounting surface 28*a*. The first stage 27 or second stage 28 on which the semiconductor substrate 1 is mounted is then moved to the treatment point 9*d*, where pre-treatment is performed by the pre-treatment section 9. After the pre-treatment has been completed, the pre-treatment section 9 moves the first stage 27 or the second stage 28 to the relay point 9*c*. Subsequently, the transport section 13 removes the semiconductor substrate 1 from the mounting surface 27*a* or the mounting surface 28*a*.

Cooling Section

The cooling section 11 has cooling panels 110*a*, 110*b*, such as heat sinks or the like, which are respectively furnished to the treatment locations 11*a*, 11*b*, and which have a suction retention face at the upper face.

The treatment locations 11*a*, 11*b* (the cooling panels 110*a*, 110*b*) are positioned within the range of operation of the grasping section 13*a*, with the cooling panels 110*a*, 110*b* lying exposed at the treatment locations 11*a*, 11*b*. Consequently, the transport section 13 can readily rest the semiconductor substrates 1 on the cooling panels 110*a*, 110*b*. After the semiconductor substrates 1 have been cooled, the semiconductor substrates 1 stand by on the cooling panel 110*a* positioned at the treatment location 11*a*, or on the cooling panel 110*a* positioned at the treatment location 11*b*. Consequently, the grasping section 13*a* of the transport section 13 can readily grasp and transport the semiconductor substrates 1.

Coating Section

Figure 4:
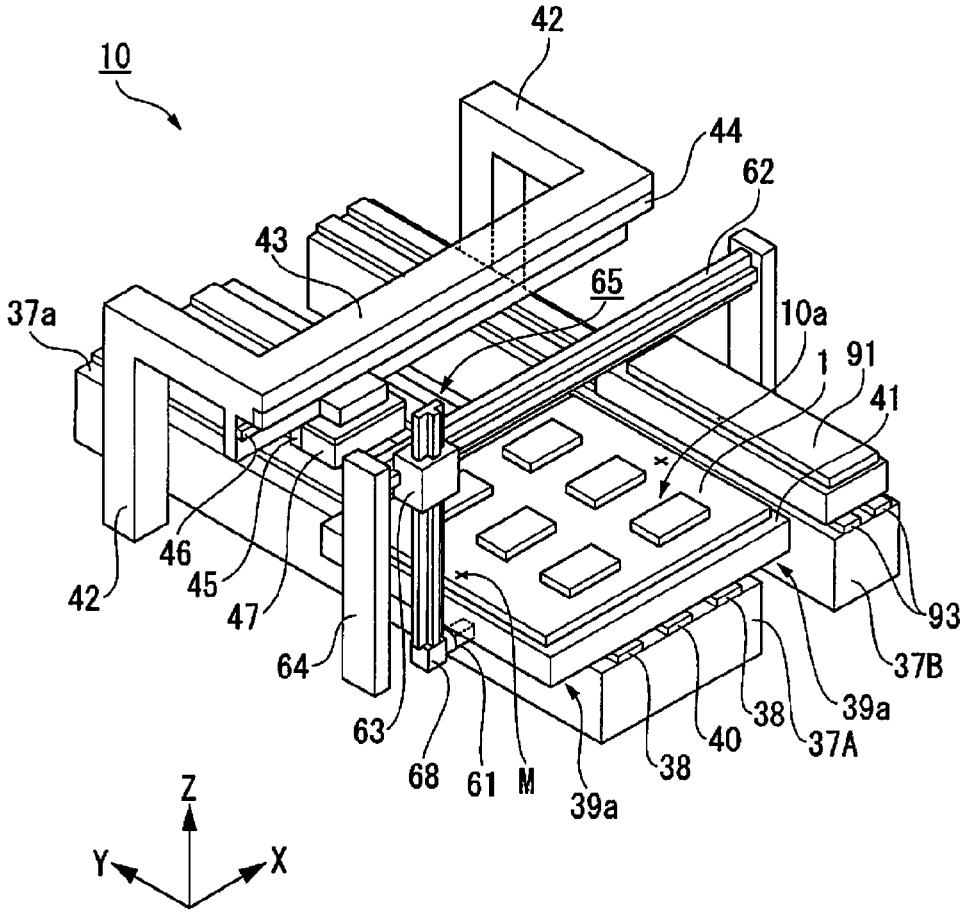
FIG. 4 is a simplified perspective view showing the configuration of a coating section.

The following is a description of the coating section 10 for discharging droplets onto the semiconductor substrate 1 to form a mark, with reference to FIGS. 4 and 5. The device for discharging the droplets is any of various types of devices, but a device which uses an ink jet method is preferable. The ink jet method is capable of discharging minute droplets and is therefore suited for fine processing.

FIG. 4 is a simplified perspective view showing the configuration of a coating section. Liquid is ejected on the semiconductor substrate 1 by the coating section 10. As shown in FIG. 4, the coating section 10 is provided with a first base 37A formed with a cuboid shape. Herein, the direction of relative movement of the object of ejection and the ejection head when the first base 37A ejects droplets is designated as the main scanning direction. A direction orthogonal to the main scanning direction is designated as the sub-scanning direction. The sub-scanning direction is the direction of relative movement of the ejection head and the object of ejection during line breaking. In the present embodiment, the X direction is designated as the main scanning direction, and the Y direction as the sub-scanning direction.

A pair of guide rails 38 that extend in the Y direction protrude up from the upper face 37*a* of the first base 37A and extend across the entire width thereof in the Y direction. A stage 39 provided with direct drive mechanisms, not shown, corresponding to the pair of guide rails 38 is attached at the upper side of the first base 37A. As the direct drive mechanisms for the stage 39, there could be employed linear motors, screw type direct drive mechanisms, or the like. In the present embodiment, linear motors are adopted, for example. Outbound movement or return movement takes place at a predetermined speed in the Y direction. Repeated outbound movement or return movement is termed scanning movement. Additionally, a sub-scanning position detector 40 is disposed parallel to the guide rails 38 on the upper face 37*a* of the first base 37A, and the position of the stage 39 is detected by the sub-scanning position detection device 40.

A resting face 41 is formed on the upper face of this stage 39, and a suction type substrate chuck mechanism, not shown, is furnished to the resting face 41. After the semiconductor substrate 1 has been rested on the resting face 41, the semiconductor substrate 1 is secured onto the resting face 41 by the substrate chuck mechanism. The stage 39 is configured to have a larger dimension in the X direction than the first stage 37A. Specifically, the stage 39 has an overhanging section 39*a* that overhangs a side of the first stage 37A in the X direction. The overhanging section 39*a* constitutes part of the resting face 41 on which the semiconductor substrate 1 rests. Through-holes 39*b* are formed in the overhanging section 39*a* of the stage 39.

A point on the mounting surface 41 when the stage 39 is positioned in the −Y direction serves as a relay point 10*a*. The mounting surface 41 is installed so as to be exposed within the operating range of the grasping sections 13*a*. Accordingly, the transport section 13 is readily able to mount the semiconductor substrate 1 onto the mounting surface 41. After the semiconductor substrate 1 has been coated, the semiconductor substrate 1 is put on standby on the mounting surface 41, being the relay point 10*a*. Accordingly, the grasping sections 13*a* of the transport section 13 are readily able to move gripping the semiconductor substrate 1.

The coating section 10 is also provided with a second stage 37B furnished concomitantly with the first stage 37A. A pair of guide rails 93 that extend in the Y direction protrude up from the upper face of the second base 37B and extend across the entire width thereof in the Y direction. A stage 90 (one example of a supporting section) provided with direct drive mechanisms, not shown, corresponding to the pair of guide rails 93 is attached at the upper side of the second base 37B. As the direct drive mechanisms for the stage 90, there could be employed linear motors, screw type direct drive mechanisms, or the like. In the present embodiment, linear motors are adopted, for example. Outbound movement or return movement takes place at a predetermined speed in the Y direction. Additionally, a sub-scanning position detection device, not shown, is disposed parallel to the guide rails 93 on the upper face of the second base 37B, and the position of the stage 90 is detected by the sub-scanning position detection device.

Also, a nozzle dropout detection area 90*a* is established on the upper face of the stage 90. Herein, nozzle dropout refers to whether or not ink droplets are ejected in satisfactory fashion from the nozzles of the drop ejection head. In the nozzle dropout detection area 90*a*, a test sheet (liquid landing member) 91 for ink ejected from the nozzles is formed on the upper face of the stage 39, at the +X direction side thereof.

Ink ejected from the nozzles lands on the test sheet 91. The test sheet 91 is detachable from the stage 90, and once a predetermined length of time has passed is replaced with a new one. Based on this configuration, in association with movement of the stage 39 over the first base 37A, the test sheet 91 is conveyed to below the drop ejection head together with the stage 39. In so doing, ink can be ejected onto the test sheet 91 from all of the nozzles of the drop ejection head.

The coating section 10 according to the present embodiment is adapted to perform nozzle dropout testing of the drop ejection head, for example, during initial filling with ink; when driving again after the ink ejection operation has been suspended for an extended period; or when a predetermined length of time has passed.

Returning to FIG. 4, a pair of support bases 42 are disposed upright at both sides of the first base 37A and the second base 37B in the X direction; and a guide member 43 extending in the X direction spans the pair of support bases 42. A guide rail 44 extending in the X direction protrudes across the entire width of the guide member 43 in the X direction at the lower side thereof. A carriage (moving means) 45 moveably mounted onto the guide rail 44 is formed with a generally cuboid shape. The carriage 45 is provided with a direct drive mechanism; as the direct drive mechanism, there may be employed a mechanism comparable to the direct drive mechanisms provided to the stage 39, for example. The carriage 45 undergoes scanning movement in the X direction. A main scanning position detection device 46 is disposed between the guide member 43 and the carriage 45, and measures the position of the carriage 45. A linear encoder is employed as the main scanning position detection device 46. The main scanning position detection device 46 is electrically connected to the controller 14, and transmits the results of measurement to the controller 14. A head section 47 is disposed to the lower side of the carriage 45, and a drop ejection head, not shown, protrudes from the face of the head section 47 on the stage 39 side thereof.

In order to eject droplets accurately onto the semiconductor substrate 1, it is necessary for the semiconductor substrate 1 per se to be disposed accurately through alignment thereof with respect to the resting face 41 of the stage 39. The printing device 7 according to the present embodiment is provided with an alignment section (camera position control mechanism) 65, so that the semiconductor substrate 1 can be disposed accurately on the stage 39 by the alignment section 65. The alignment section 65 is electrically connected to the controller 14, which performs control thereof.

The alignment section 65 is provided with a guide member 62 extending in the X direction; a moving section 63 adapted to move across the guide member 62; an alignment camera 61 for photographing alignment marks M furnished to the semiconductor substrate 1; a shaft section 67 disposed on the moving section 63; and a rotating section 68 rotatable with respect to the shaft section 67 and adapted to retain the alignment camera 61. The rotating section 68 retains the alignment camera 61 rotatably about the X axis and the Z axis. Therefore, it is possible for a photographing face 61*a* of the alignment camera 61 to face towards the −Z direction or the +Z direction. The guide member 62 is secured to the pair of support bases 64 disposed upright at both sides of the first base 37A and the second base 37B in the X direction.

The shaft section 67 is furnished with a guide rail 67*a* extending in the Z direction, whereby the shaft section 67 is moveable in the Z direction (vertical direction) with respect to the moving section 63 by a drive mechanism, not shown. Additionally, the guide member 62 is furnished with a guide rail 62*a* extending in the X direction, whereby the moving section 63 is moveable in the X direction with respect to the guide member 62 by a drive mechanism, not shown.

In the present embodiment, once the controller 14, based on information input from the input section 19, has recognized that alignment marks M are furnished on the front face 1*a* side of the semiconductor substrate 1, it drives the alignment section 65.

Figure 5A:
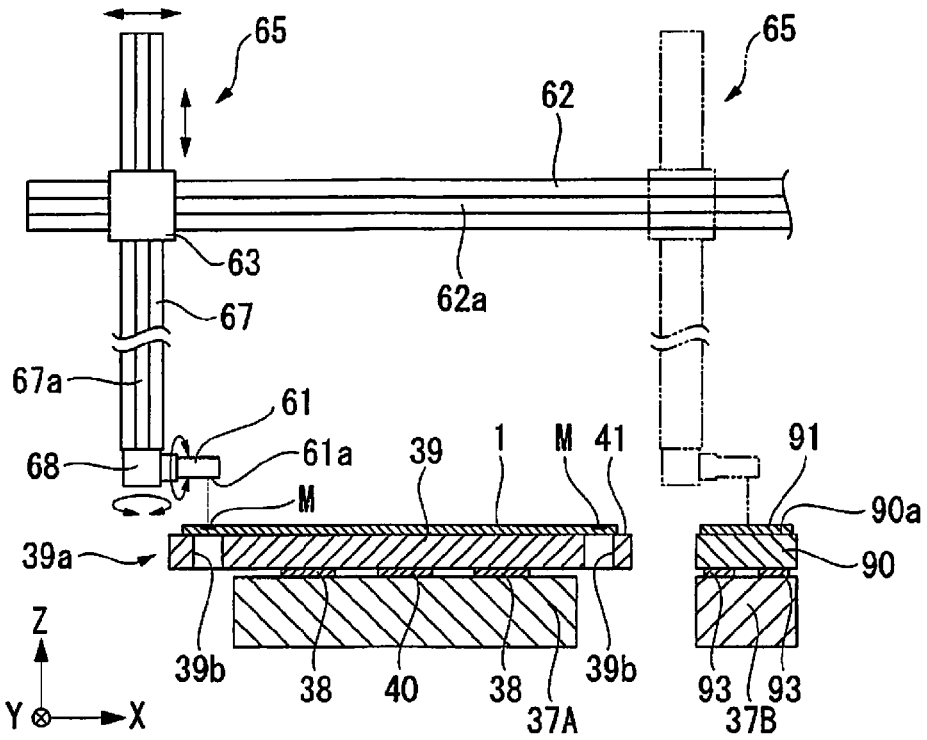
FIGS. 5A and 5B are diagrams describing operation of an alignment section.
Figure 5B:
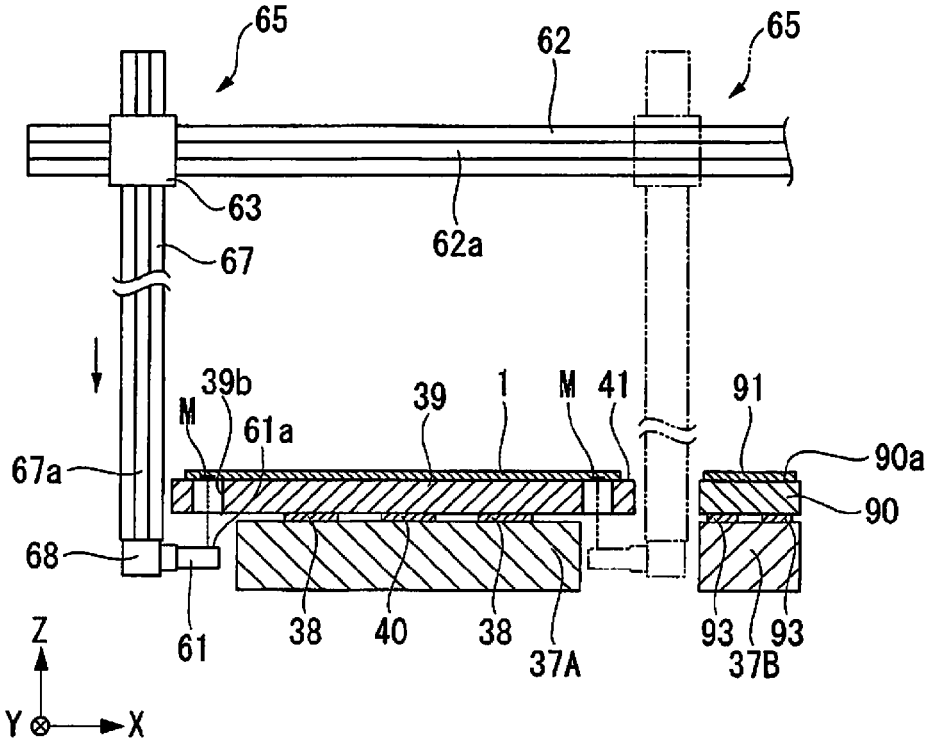

FIG. 5 describes operation of the alignment section 65, with FIG. 5A showing a state in which the alignment marks M are photographed from above the semiconductor substrate 1, and FIG. 5B showing a state in which the alignment marks M are photographed from below the semiconductor substrate 1.

As shown in FIG. 5A, the alignment section 65 positions the rotating section 68 to the upper face side of the semiconductor substrate 1, as well as facing the photographing face 61*a* of the alignment camera 61 towards the stage 39, thereby making it possible to photograph the alignment marks M on one side (the side towards the −X direction) of the semiconductor substrate 1 on the resting face 41 of the stage 39. Additionally, the alignment section 65 moves the moving section 63 towards the +X direction across the guide member 62 to move the alignment camera 61 to the other end of the stage 39, and by driving the rotating section 68, rotates the orientation of the alignment camera 61 by 180 degrees about the Z axis. It is then possible to photograph the alignment marks M on the other side (the side towards the +X direction) of the semiconductor substrate 1 on the resting face 41.

The image photographed by the alignment camera 61 is sent to the controller 14, whereupon the controller 14 ascertains from the positions of the alignment marks M the amount of positional displacement of the semiconductor substrate 1 with respect to the resting face 41 of the stage 39. The controller 14 then fine-tunes the position of the grasping section 13*a* of the transport section 13 to dispose the semiconductor substrate 1 at a predetermined position with respect to the resting face 41. This completes the operation to align the semiconductor substrate 1 with respect to the stage 39. Herein, alignment mark information may be saved to the controller 14. For example, as shown in FIG. 1A "+" (plus) marks may be saved, and the amount of positional displacement then ascertained by comparing the saved alignment mark information with the photographed image. The alignment marks are not limited thereto, and could also be the letter "L," or circular in shape.

In the preceding description, the alignment marks M are furnished on the front face 1*a* side of the semiconductor substrate 1, but it is also possible for the alignment section 65 to satisfactorily photograph a semiconductor substrate 1 furnished with alignment marks M on the back face 1*b* side.

In specific terms, as shown in FIG. 5B, the alignment section 65 positions the rotating section 68 to the bottom face side of the semiconductor substrate 1, and faces the photographing face 61*a* of the alignment camera 61 towards the stage 39, whereby it is possible to photograph the alignment marks M of the semiconductor substrate 1 via the through-holes 39*b* furnished to the stage 39.

Herein, once the alignment section 65 has moved the moving section 63 towards the −X direction across the guide member 62 and, has moved the shaft section 67 in the −Z direction with respect to the moving section 63 while avoiding contact between the alignment camera 61 and the semiconductor substrate 1, it then again moves the moving section 63 in the +X direction with respect to the guide member 62 so that the alignment camera 61 can be disposed at the position in FIG. 5B. It is possible thereby to photograph the alignment marks M on one side (the side towards the −X direction) of the semiconductor substrate 1 on the resting face 41 of the stage 39.

Additionally, once the alignment section 65 has moved the moving section 63 towards the +X direction across the guide member 62 to move to the alignment camera 61 to the other end of the stage 39, it then moves the shaft section 67 downward while driving the rotating section 68, thereby disposing the alignment camera along the Y direction. Once the alignment camera 61 has passed through the gap between the stage 39 and the stage 90, the alignment camera 61 is disposed facing towards the −X direction and the photographing face 61*a* is faced upward, thereby making it possible to photograph the alignment marks M of the semiconductor substrate 1 via the through-holes 39*b* furnished to the stage 39.

The image photographed by the alignment camera 61 is sent to the controller 14, whereupon the controller 14 adjusts the position of the grasping section 13*a* in the above manner, thereby making possible alignment of the semiconductor substrate 1 to a predetermined position with respect to the resting face 41.

In the above manner, the alignment section 65 according to the present embodiment has a configuration that enables switching between a first state for photographing the alignment marks M of the semiconductor substrate 1 on the stage 39 from one planar side (the +Z direction side with respect to the stage 39) (one example of a first face), and a second state for photographing the alignment marks M of the semiconductor substrate 1 on the stage 39 from the other planar side (the −Z direction side with respect to the stage 39) (one example of a second face).

During nozzle dropout testing, firstly, ink is ejected onto the aforedescribed test sheet 91 from all of the nozzles of the drop ejection head. Here, ink is ejected onto the test sheet 91 from all the nozzles of the drop ejection head; however, it is also acceptable to eject ink from a portion of the nozzles. The controller 14 then employs the alignment camera 61 of the alignment section 65 to photograph the ink landing face of the test sheet 91. At this time, as shown in FIG. 5A, the alignment section 65 moves the moving section 63 towards the +X direction across the guide member 62, so that the ink landing face of the test sheet 91 which has been placed in the nozzle dropout detection area 90*a* of the stage 39 can be photographed.

The image photographed by the alignment camera 61 is sent to the controller 14, whereupon the controller 14 analyzes the image in order to verify whether ink has been ejected in satisfactory fashion from the nozzles of the drop ejection head. Thereby, in cases in which nozzle dropout has been detected, nozzle dropout can be resolved by employing a maintenance device, not shown, as needed in order to perform a maintenance process (for example, a flushing process, a suction process, a wiping process, or the like) to resolve nozzle dropout. Herein, a pattern to be formed on the test sheet based on data instructing ejection onto the test sheet 91 from the drop ejection head may be recorded to the controller. The controller would then compare this data with the photographed image, to verify whether ink has been ejected in satisfactory fashion from the nozzles of the drop ejection head. Specifically, the controller 14 constitutes the nozzle dropout determining section of the present invention.

By performing nozzle dropout testing in the above manner, the printing device 7 according to the present embodiment is able to maintain a state of satisfactory ejection of ink from the nozzles. A highly reliable device providing high print quality onto the semiconductor substrates 1 is afforded thereby.

In the present embodiment shown above, the position of the alignment camera 61 is controlled so as to enable switching of the alignment section 65 between an alignment state (the first state or second state) enabling photographing of alignment marks M furnished on the semiconductor 1, and a nozzle dropout testing state (third state) for photographing the ink landing face of the test sheet 91.

Figure 6:
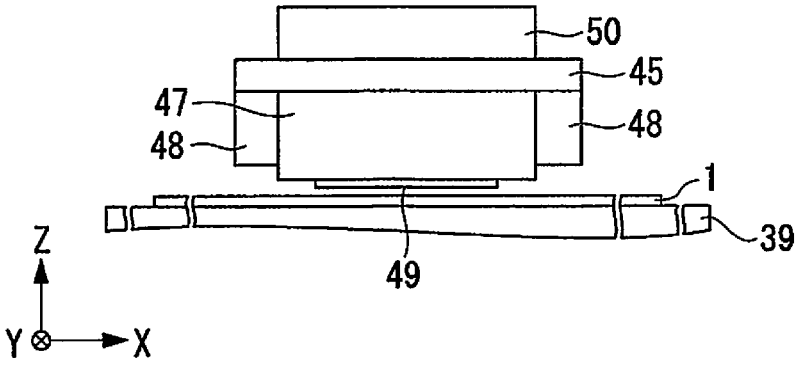
FIG. 6 is a schematic side view showing a carriage.

FIG. 6 is a schematic side view illustrating a carriage. As illustrated in FIG. 4B, the head section 47 and a pair of curing sections (irradiation sections) 48 serving as irradiation sections are arranged on the semiconductor substrate 1 side of the carriage 45. A convex liquid droplet discharge head (discharge head) 49 for discharging droplets is provided to the semiconductor substrate 1 side of the head section 47.

An irradiation device for irradiating with ultraviolet light, which causes the discharged droplets to be cured, is arranged on the interior of the curing section 48*s*. The curing sections 48 are arranged on positions on both sides surrounding the head section 47 in the primary scanning direction (the relative movement direction). The irradiation device is constituted of a light-emitting section and a heatsink or the like. A plurality of light emitting diode (LED) elements are installed in series on the light-emitting section. The LED sections are elements supplied with electrical power to emit ultraviolet light, which is light in the ultraviolet range.

A housing tank 50 is arranged on the upper side of the carriage 45 as shown, and ink (the functional liquid) is housed in the housing tank 50. The liquid droplet discharge head 49 and the housing 50 are connected by a tube (not shown), and the functional liquid inside the housing tank 50 is supplied to the liquid droplet discharge head 49 via a tube.

The functional liquid contains as primary materials a resin material, a photopolymerization initiator functioning as a curing agent, and a solvent or dispersion medium. Functional liquids having specific functionality can be formed by adding to these primary materials coloring matter such as pigments, dyes, and the like; surface modifying materials with hydrophilic or water repellent properties; and other such functional materials. In the present embodiment, for example, a white pigment is added. The resin material of the functional liquid is a material that forms a resin film. The resin material is not particularly limited, provided that the material is liquid at normal temperature, and forms a polymer through polymerization. Furthermore, in preferred practice, the resin material has low viscosity, and takes the form of an oligomer. More preferably it will take the form of a monomer. The photopolymerization initiator is an additive that acts on crosslinking groups to the polymer to promote a crosslinking reaction; benzyl dimethyl ketal or the like can be used as the photopolymerization initiator, for example. The solvent or dispersion medium adjusts the viscosity level of the resin material. Where the viscosity level of the functional liquid is one facilitating ejection from the drop ejection head, the functional liquid can be ejected in a stable fashion from the drop ejection head.

Figure 7A:
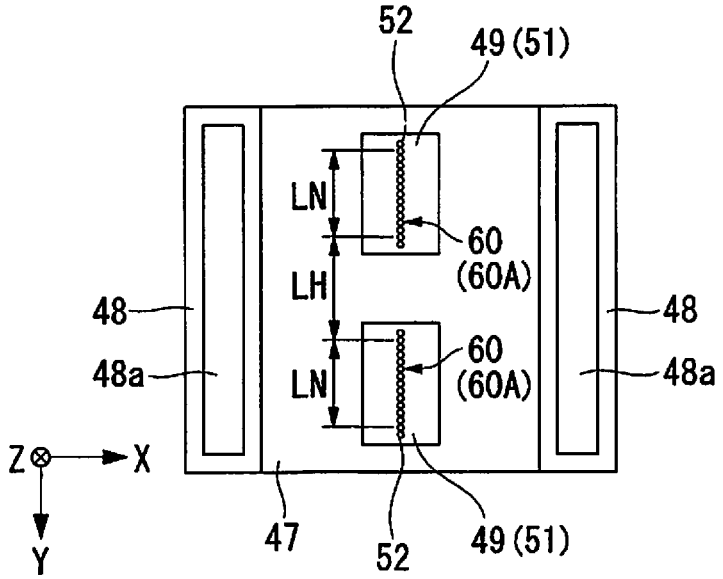
FIG. 7A is a schematic plan view showing a head section.
Figure 7B:
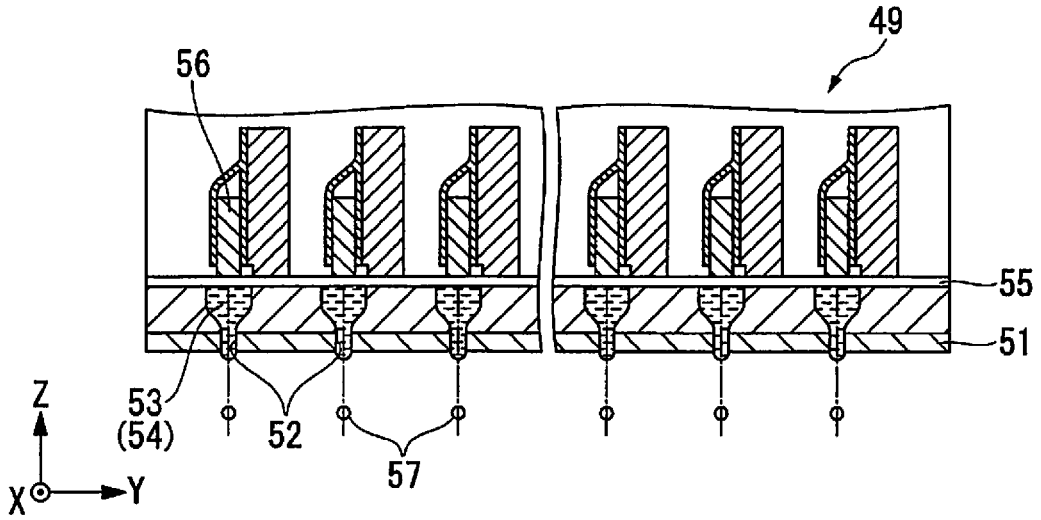
FIG. 7B is a fragmentary schematic cross sectional view describing the structure of a liquid ejection head.

FIG. 7A is a schematic plan view illustrating a head section. As illustrated in FIG. 7A, two liquid droplet discharge heads 49 constituting a first and a second discharge head at arranged on the head section 47 and create a gap in the secondary scanning direction; a nozzle plate 51 is arranged on the surface of each of the liquid droplet discharge heads 49. A plurality of nozzles 52 are formed in series on each of the nozzle plates 51. In the present embodiment, each of the nozzle plates 51 is provided with one nozzle column 60 in which 15 nozzles 52 are arranged along the secondary scanning direction. The two nozzle columns 60 are arranged in a linear manner along the Y direction and are arranged with regard to the X direction in positions equally spaced on both sides of the curing section 48.

The nozzles 52 arranged at the two ends of the nozzle columns 60 in each of the liquid droplet discharge heads 49 trend toward having unsafe characteristics for discharging droplets and are therefore not used for liquid droplet discharge treatments. That is, in the present embodiment, 13 nozzles 52, excluding the two end nozzles 52, form an actual nozzle column 60A for discharging droplets onto the semiconductor substrate 1 in actual practice.

Herein, the adjacent liquid droplet discharge heads 49 are arranged in a positional relationship satisfying the following formula, where LN is the length in the secondary scanning direction of each of the actual nozzle columns 60A, and LH is the distance in the secondary scanning direction between the actual nozzle columns 60A of the respective adjacent liquid droplet discharge heads 49.

$$LH=n\times LN \text{ (}n\text{ is a positive integer)} \quad (1)$$

In the present embodiment, the two liquid droplet discharge heads 49 are arranged along the Y direction in a positional relationship where n=1, i.e., where LH=LN.

Irradiation ports 48*a* are formed on the lower surface of the curing section 48. The irradiation ports 48*a* are provided so as to have an irradiation range at least as a long as the sum of the length of the discharge heads 49, 49 in the Y direction and the distance between the discharge heads 49, 49. Ultraviolet light emitted by the irradiation device is irradiated toward the semiconductor substrate 1 from the irradiation ports 48*a*.

FIG. 5B is a schematic cross-sectional view for describing the structural elements of the liquid droplet discharge head. As illustrated in FIG. 5B, the liquid droplet discharge head 49 is provided with the nozzle plate 51, and the nozzles 52 are formed on the nozzle plate 51. A cavity 53 communicating with the nozzles 52 is formed at a position on the upper side of the nozzle plate 51 and opposite the nozzles 52. The functional liquid (liquid) 54 is supplied to the cavity 53 of the liquid droplet discharge head 49.

A vibration plate 55 for vibrating in the up-down direction to enlarge and reduce the volume inside the cavity 53 is installed on the upper side of the cavity 53. A piezoelectric element 56 for expanding and contracting in the up-down direction to cause the vibration plate 55 to vibrate is arranged at a point facing opposite the cavity 53 on the upper surface of the vibration plate 55. The piezoelectric element 56 expands and contracts in the up-down direction to apply pressure on and vibrate the vibration plate 55, and the vibration plate 55 enlarges and reduces the volume inside the cavity 53 to apply pressure on the cavity 53. The pressure inside the cavity 53 is thereby made to fluctuate, and the functional liquid 54 having been supplied to the inside of the cavity 53 is discharged through the nozzles 52.

When the liquid droplet discharge head 49 receives a nozzle drive signal for controlling the drive of the piezoelectric element 56, the piezoelectric element 56 expands and the vibration plate 55 reduces the volume inside the cavity 53. Consequently, an amount of functional liquid 54 equivalent to the reduction in volume is discharged as droplets 57 from the nozzles 52 of the liquid droplet discharge head 49. The semiconductor substrate 1, which has been coated with the functional liquid 54, is irradiated with ultraviolet light from the irradiation ports 48*a*, and the functional liquid 54, which contains a curing agent, is thus made to solidify or cure.

Storage Receptacle

Figure 8A:
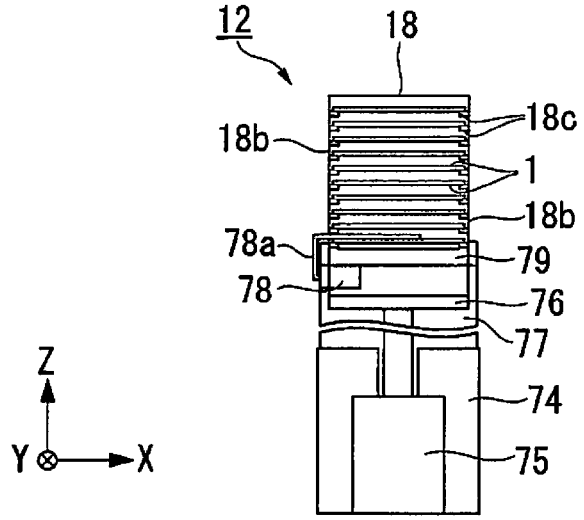
FIGS. 8A to 8C is a schematic view showing a storage section.
Figure 8B:
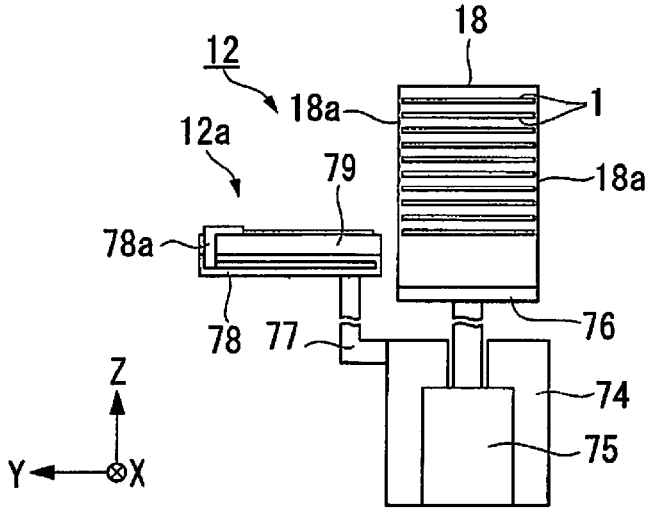
Figure 8C:
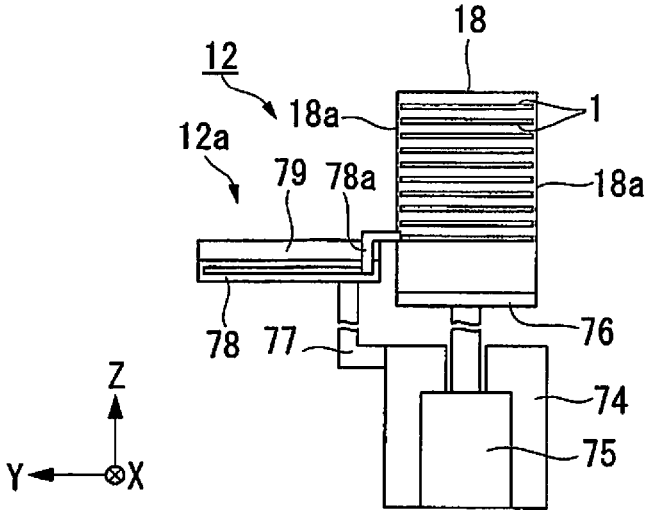

FIG. 8A is a schematic front view illustrating a storage receptacle, and FIGS. 8B and 8C are schematic side views illustrating a storage receptacle. As illustrated by FIGS. 8A and 8B, a storage receptacle 12 is provided with a base stage 74. A vertical motion device 75 is installed on the interior of the base stage 74. The vertical motion device 75 used can be a similar device to the vertical motion device 16 installed in the supply section 8. A vertical motion plate 76 is installed on the upper side of the base stage 74 so as to be connected with the vertical motion device 75. The vertical motion plate 76 is lifted and lowered by the vertical motion device 75. A cuboid storage receptacle 18 is installed on top of the vertical motion plate 76, and the semiconductor substrates 1 are housed within the storage receptacle 18. The storage receptacle 18 used is the same container as the storage receptacle 18 installed in the supply section 18.

A substrate pusher 78 and a relay stage 79 are installed via a support member 77 on the Y direction side of the base stage 74. The relay stage 79 is arranged at a point in the Y direction side of the storage receptacle 18 so as to overlap onto the substrate pusher 78. The substrate pusher 78 is provided with an arm part 78*a* which moves in the Y direction, as well as with a linear movement mechanism for driving the arm part 78*a*. The linear movement mechanism is not particularly limited, that the linear movement mechanism be a mechanism for moving in a linear manner; the present embodiment employs an air cylinder operated by compressed air, by way of example. The semiconductor substrate 1 is mounted onto the relay stage 79 and an arm part 78*a* is allowed to make contact with the middle of one end of the Y direction side of the semiconductor substrate 1.

The substrate pusher 78 causes the arm part 78*a* to move in the −Y direction, whereby the arm part 78*a* causes the semiconductor substrate 1 to move in the −Y direction. The relay stage 79 has a concave part formed so as to have substantially the same width as the width in the X direction of the semiconductor substrate 1, and the semiconductor substrate 1 moves along the concave part. The position in the X direction of the semiconductor substrate 1 is determined by the concave part. Consequently, as illustrated in FIG. 8C; the semiconductor substrate 1 is made to move into the storage receptacle 18. The rails 18*c* being formed in the storage receptacle 18, the rails 18*c* are positioned on the line of extension of the concave part formed on the relay stage 79. The semiconductor substrate 1 is made to move along the rails 18*c* by the substrate pusher 78. The semiconductor substrate 1 is thereby safely housed in the storage receptacle 18.

After the transport section 13 has moved the semiconductor substrate 1 onto the relay stage 79, the vertical motion device 75 lifts the storage receptacle 18. Then, the substrate pusher 78 drives the arm part 78*a* and moves the semiconductor substrate 1 into the storage receptacle 18. The storage receptacle 12 thus houses the semiconductor substrate 1 in the storage receptacle 18. After a predetermined number of semiconductor substrates 1 have been housed in a storage receptacle 18, the operator replaces the storage receptacle 18 in which the semiconductor substrates 1 have been housed with another empty storage receptacle 18. The operator is thereby able to carry a plurality of semiconductor substrates 1 together in the following steps.

The storage receptacle 12 has a relay point 12*a* for mounting the housed semiconductor substrates 1. The transport section 13 is able to cooperate with the storage receptacle 12 to house the semiconductor substrates 1 in the storage receptacle 18 merely by mounting the semiconductor substrates 1 onto the relay point 12*a*.

Transport Section

Figure 9:
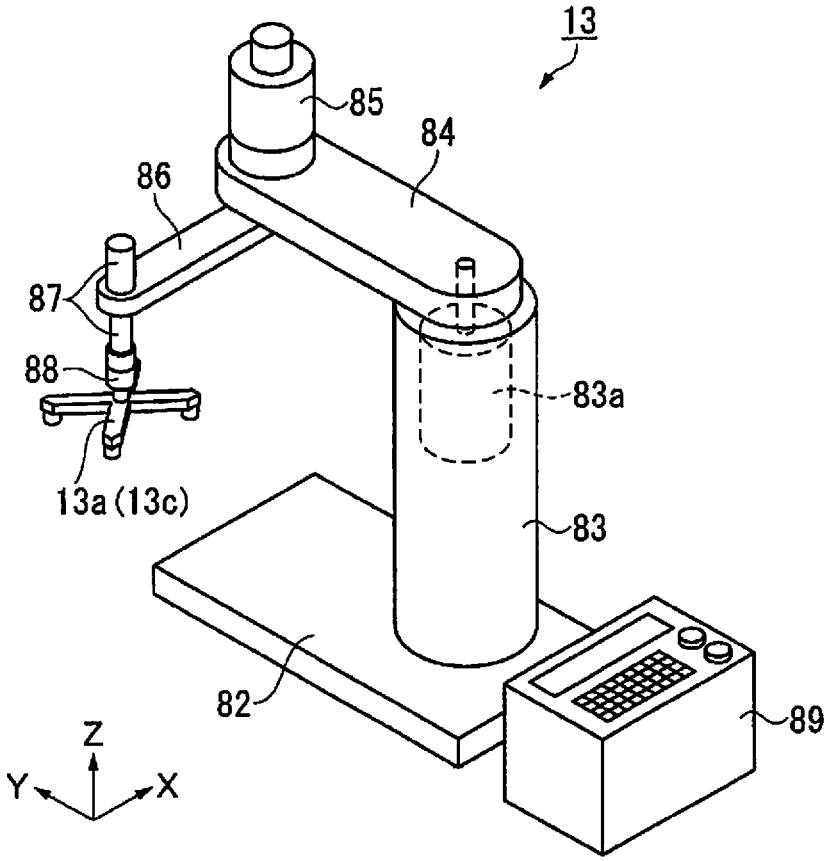
FIG. 9 is a simplified perspective view showing the configuration of a transport section.

The following is a description of the transport section 13 for transporting the semiconductor substrate 1, with reference to FIG. 9. FIG. 9 is a schematic perspective view illustrating the configuration of a transport section. As illustrated in FIG. 9, the transport section 13 is provided with a base stage 82 formed in a planar shape. A support stage 83 is arranged on the base stage 82. A hollow is formed in the interior of the support stage 83, and a rotation mechanism 83*a* constituted of a motor, an angle detector, a decelerator, and the like is installed in the hollow. The output shaft of the motor is connected to the decelerator, and the output shaft of the decelerator is connected to a first arm part 84 arranged on the upper side of the support stage 83. The angle detector is installed so as to be connected to the output shaft of the motor; the angle detector detects the angle of rotation of the output shaft of the motor. It is thereby possible to detect the angle of rotation of the first arm part 84 and to cause the rotation mechanism 83*a* to rotate at a desired angle.

A rotation mechanism 85 is installed at the end of the first arm part 84 on the side opposite to the support stage 83. The rotation mechanism 85 is constituted of a motor, an angle detector, a decelerator, and the like, and is provided with a similar function to that of the rotation mechanism installed inside the support stage 83. An output shaft of the rotation mechanism 85 is connected to a second arm part 86. It is thereby possible to detect the angle of rotation of the second arm part 86 and to cause the rotation mechanism 85 to rotate at a desired angle.

A vertical motion device 87 is arranged at the end of the second arm part 86 on the side opposite to the rotation mechanism 85. The vertical motion device 87 is provided with a linear movement mechanism, and expands and contracts by driving the linear movement mechanism. The linear movement mechanism used can be a similar mechanism to that of, for example, the vertical motion device 16 of the supply section 8. A rotation device 88 is arranged on the lower side of the vertical motion device 87.

The rotation device 88, with the provision of being able to control the angle of rotation, can be constituted of the combination of any kind of motor with a rotational angle sensor. It is additionally possible to use a stepper motor capable of rotating the angle of rotation at a predetermined angle. The present embodiment employs a stepper motor, by way of example. A deceleration device may also be further arranged. Rotation at an even finer angle is thereby possible.

The grasping sections 13*a* are arranged on the lower side of the rotation device 88 as shown. The grasping sections 13*a* are connected to the rotating shaft of the rotation device 88. Accordingly, the grasping sections 13*a* can be rotated by driving the rotation device 88. Further, the grasping sections 13*a* can be raised and lowered by driving the vertical motion device 87.

The grasping sections 13*a* have four finger parts 13*c* having linear shapes, and a chuck mechanism for suction-chucking the semiconductor substrate 1 is formed on the tips of the finger parts 13*c*. The grasping sections 13*a* operate the chuck mechanism to be able to grip the semiconductor substrate 1.

A control device 89 is installed on the −Y direction side of the base stage 82. The control device 89 is provided with a central computation device, a memory section, an interface, an actuator drive circuit, an input device, a display device, and the like. The actuator drive circuit is a circuit for driving the rotation mechanism 83*a*, the rotation mechanism 85, the vertical motion device 87, the vertical motion device 88, and the chuck mechanism of the grasping sections 13*a*. These devices and the circuit are coupled to the central computation device via the interface. Additionally, the angle detectors are also coupled to the central computation device via the interface. The memory section stores data used for controlling and program software indicating the operational sequence for controlling the transport section 13. The central computation device is a device for controlling the transport section 13 in accordance with the program software. The control device 89 inputs the output of the detectors arranged on the transport section 13 and detects the position and orientation of the grasping sections 13*a*. The control device also drives the rotation mechanism 83*a* and the rotation mechanism 85 to control such that the grasping sections 13*a* are moved to predetermined positions.

Printing Method

Figure 10:
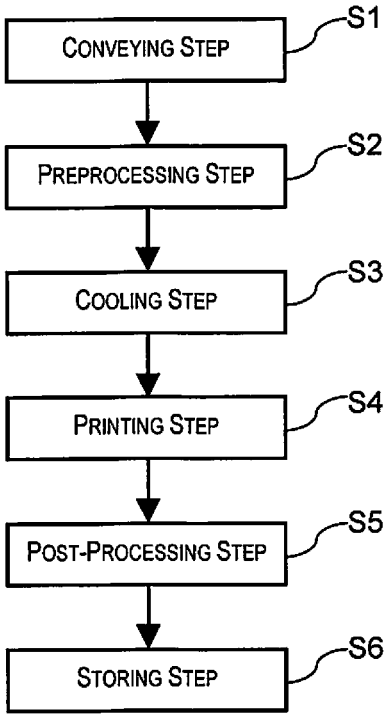
FIG. 10 is a flowchart showing a printing method.

Next, a printing method employing the printing device 7 discussed previously is described in FIG. 10. FIG. 10 is a flowchart showing a printing method.

As shown by the flowchart of FIG. 10, the printing method is constituted primarily of an conveying step S1 in which the semiconductor substrate 1 is introduced from the storage receptacle 18; a preprocessing (pre-treatment) step S2 in which the surface of the introduced semiconductor substrate 1 undergoes pretreatment; a cooling step S3 in which the semiconductor substrate 1 is cooled down from its elevated temperature in the preprocessing step S2; a printing step S4 in which various types of marks are drawn and printed onto the cooled semiconductor substrate 1; a post-processing (post-treatment) step S5 in which the semiconductor substrate 1 imprinted with various types of marks undergoes post-treatment; and a storing step S6 in which the post-treated semiconductor substrate 1 is stored in the storage receptacle 18.

Of the aforedescribed steps, the steps from the preprocessing step S2 to the printing step S4 are characteristic parts of the present invention, and therefore these characteristic parts will be discussed in the following discussion.

In the preprocessing step S2, one of the stages, either the first stage 27 or the second stage 28, is positioned at a relaying location 9*c* in the pretreatment section 9. The transport section 13 moves the grasping section 13*a* to a location facing the stage which is positioned at the relaying location 9*c*. Next, the transport section 13 lowers the grasping section 13*a*, and thereafter releases suction on the semiconductor substrate 1, whereby the semiconductor substrate 1 is rested on the first stage 27 or the second stage 28 positioned at the relaying location 9*c*. As a result, the semiconductor substrate 1 is rested on the first stage 27 positioned at the relaying location 9*c* (see FIG. 3B), or the semiconductor substrate 1 is rested on the second stage 28 positioned at the relaying location 9*c* (see FIG. 3A).

The first stage 27 and the second stage 28 are preheated by the heating devices 27H, 28H, and the semiconductor substrate 1, once rested on the first stage 27 or the second stage 28, is quickly heated to a predetermined temperature. As will be discussed later, the temperature to which the semiconductor substrate 1 is heated is preferably one that enables effective modification of the surface of the semiconductor substrate 1 or elimination of organic matter from the surface thereof to be performed efficiently, while being equal to or less than the upper temperature limit of the semiconductor substrate 1. In the present embodiment, the semiconductor substrate 1 is heated to a temperature within a range of 150° C. to 200° C., for example, to 180° C.

When the transport section 13 moves the semiconductor substrate 1 onto the first stage 27, the semiconductor substrate 1 that is on the second stage 28 is being pre-treated at the treatment point 9*d*, which is in the interior of the pre-treatment section 9. Then, after the pre-treatment of the semiconductor substrate 1 on the second stage 28 is completed, the second stage 28 moves the semiconductor substrate 1 to the relay point 9*b*. Next, the pre-treatment section 9 drives the first stage 27 and thereby moves the semiconductor substrate 1 mounted onto the first relay point 9*a* to the treatment point 9*d*, which is facing opposite the carriage 31. It is thereby possible to begin pre-treating the semiconductor substrate 1 that is on the first stage 27 immediately after the pre-treatment of the semiconductor substrate 1 that is on the second stage 28 has been completed.

Subsequently, the semiconductor device 3 installed onto the semiconductor substrate 1 is irradiated with ultraviolet light in the pre-treatment section 9. Thereby, the chemical bonds in the organic materials to be irradiated in the surface layer of the semiconductor device 3 are severed, and the active oxygen separated from the ozone generated by the ultraviolet light binds to the severed molecules in the surface layer and are converted to highly hydrophilic functional groups (for example, —OH, —CHO, —COOH). The surface of the substrate 1 is thereby modified, and the organic matter in the surface is removed. Herein, the semiconductor device 3 (the semiconductor substrate 1), as has been described above, is irradiated with ultraviolet light in a state of having been pre-heated to 180° C., and therefore the semiconductor substrate 1 will not suffer any damage, and the molecules in the surface layer will collide at a higher rate; the surface can be effectively modified, and the organic matter in the surface can be effectively removed. After the pre-treatment has been performed, the pre-treatment section 9 drives the first stage 27 and thereby moves the semiconductor substrate 1 to the relay point 9*a*.

Similarly, when the transport section 13 moves the semiconductor substrate 1 onto the second stage 28, the semiconductor substrate 1 that is on the first stage 27 is being pre-treated at the treatment point 9*d*, which is in the interior of the pre-treatment section 9. The first stage 27 moves the semiconductor substrate 1 to the relay point 9*a* after the pre-treatment of the semiconductor substrate 1 that is on the first stage 27 has been completed. Next, the pre-treatment section 9 drives the second stage 28 and thereby moves the semiconductor substrate 1 having been mounted onto the second relay point 9*b* to the treatment point 9*d*, which is facing opposite the carriage 31. It is thereby possible to begin pre-treating the semiconductor substrate 1 that is on the second stage 28 immediately after the pre-treatment of the semiconductor substrate 1 that is on the first stage 27 has been completed. Subsequently, the pre-treatment section 9 irradiates the semiconductor device 3 installed onto the semiconductor substrate 1 with ultraviolet light, whereby, similarly with respect to the aforesaid semiconductor substrate 1 that is on the first stage 27, the semiconductor substrate 1 will not suffer any damage; the surface can be effectively modified, and the organic matter in the surface can be effectively removed. After the pre-treatment has been performed, the pre-treatment section 9 drives the second stage 28 and thereby moves the semiconductor substrate 1 to the relay point 9*b*.

Once pretreatment of the semiconductor substrate 1 in the preprocessing step S2 is finished, the process advances to the cooling step S3, whereupon the transport section 13 rests the semiconductor substrate 1 at the relaying location 9*c* on the cooling panel 110*a* or the cooling panel 110*b* which has been furnished at the treatment location 11*a* or 11*b*. In so doing, the semiconductor substrate 1 heated in the preprocessing step S2 is cooled (temperature-adjusted) for a predetermined time period to a temperature suitable for performing the printing step S4 (for example, to room temperature).

The semiconductor substrate 1 having been cooled in the cooling step S3 is conveyed by the transport section 13 onto the stage 39 which is positioned at the relaying location 10*a* of the coating section 10. The controller 14 drives the alignment section 65, and performs alignment of the semiconductor substrate 1 and the stage 39 by photographing the alignment marks M furnished on the front face 1*a* side of the semiconductor substrate 1 which has been conveyed onto the stage 39. In specific terms, as shown in FIG. 5A, the controller 14 positions the rotating section 68 to the upper face side of the semiconductor substrate 1 and faces the photographing face 61*a* of the alignment camera 61 towards the stage 39, then photographs the alignment marks M of the semiconductor substrate 1 on the resting face 41 of the stage 39. The semiconductor substrate 1 can then be disposed at a predetermined position with respect to the resting face 41 through fine-tuning of the position of the grasping section 13*a* of the transport section 13.

In the printing step S4, the coating section 10 operates the chucking mechanism to retain, at the stage 39, the semiconductor substrate 1 having been mounted onto the stage 39. The coating section 10 discharges the droplets 57 from the nozzles 52 formed on each of the liquid droplet discharge heads 49 while also moving the carriage 45 scanning relative to the stage 39 in, for example, the +X direction (relative movement).

In the manner described above, the company name mark 4, the model code 5, the serial number 6, and other marks are drawn onto the surface of the semiconductor device 3. The marks are then irradiated with ultraviolet light from the curing section 48 installed in the −X side of the carriage 45, which is the rear side in the scanning movement direction. Thereby, the surface of the marks is immediately solidified or cured, because the functional liquid 54 for forming the marks contains the photopolymerization initiator(s) by which polymerization is started due to the ultraviolet light.

At such a time, because the two liquid droplet discharge heads 49 are arranged along the Y direction, which is the secondary scanning direction, and the nozzle columns 60 are arranged in a linear manner in the Y direction as well, the pinning time between when the droplets 57 are discharged onto the semiconductor device 3 until the droplets 57 are irradiated with ultraviolet light and cured will be identical between the two liquid droplet discharge heads 49, without there being any difference.

When the carriage 45 has finished its scanning movement in the +X direction, the stage 39 is, for example, fed a distance LN (=LH) in the +Y direction. As the carriage 45 is scanned (moved) relative to the stage 39 in the −X direction, the marks are then irradiated with ultraviolet light from the curing section 48 installed in the +X side of the carriage 45, which is the rear side in the scanning movement direction, while the droplets 57 are discharged from the nozzles 52 formed on each of the liquid droplet discharge heads 49.

Thereby, the droplets are also discharged over the area between the two liquid droplet discharge heads 49 where no droplets would be discharged by a single scanning movement. Further, in the liquid droplet discharge by the second scanning movement, the pinning time between when the droplets 57 are discharged onto the semiconductor device 3 until when the droplets 57 are irradiated with ultraviolet light and cured will be identical between the two liquid droplet discharge heads 49, without there being any difference. Also, because the distance in the X direction between the nozzle columns 60 (the actual nozzle columns 60A) and the two sides of the curing section 48 is identical, the pinning time will be identical between the liquid droplet discharge by the first scanning movement and the second scanning movement.

The printing device 7 according to the present embodiment is designed to detect nozzle dropout of the nozzles in the drop ejection head of the head section 47, for example, at recurrent predetermined timing such as during initial filling with ink; when driving again after the ink ejection operation has been suspended for an extended period; or when a predetermined length of time has passed.

Nozzle dropout testing can be carried out by ejecting ink onto the test sheet 91 from all of the nozzles of the drop ejection head, photographing the ink landing face of the test sheet 91 with the alignment camera 61, and having the controller 14 analyze the photographed image to determine whether nozzle dropout is present. In a case in which the controller 14 has detected nozzle dropout, the nozzle dropout can be resolved by employing a maintenance device, not shown, as needed in order to perform a maintenance process, for example, a flushing process, a suction process, a wiping process, or the like.

Consequently, by performing nozzle dropout testing, the printing device 7 according to the present embodiment is able to maintain a state of satisfactory ejection of ink from the nozzles, and can perform a high quality printing process on the semiconductor substrates 1.

The test sheet 91 which is furnished on the upper face of the stage 39 is moveable together with the stage 39, thereby enabling the test sheet 91 to be moved to below the head section 47, whereby droplets ejected from all of the nozzles can be made to land thereon. Therefore, nozzle dropout testing can be performed for all of the nozzles.

After the semiconductor substrate 1 has been printed, the coating section 10 moves the stage 39 on which the semiconductor substrate 1 is mounted to the relay point 10*a*. The transport section 13 is thereby readily able to grip the semiconductor substrate 1. The coating section 10 also halts the operation of the chucking mechanism and releases the retention of the semiconductor substrate 1.

Thereafter, during the housing step S6, the semiconductor substrate 1 is transported to the storage receptacle 12 by the transport section 13 and then housed in the storage receptacle 18.

According to the present embodiment as described above, the alignment section 65 can switch the position of the alignment camera 61 between a first state in which the semiconductor substrate 1 is photographed from one planar face side, and a second state in which the semiconductor substrate 1 is photographed from the other planar face side. Consequently, regardless of which face of the substrate resting on the stage 39 has been furnished with the alignment marks M, these can be photographed with a single camera. Thus, it is unnecessary to provide a plurality of alignment cameras 61, and therefore increased size of the device configuration can be prevented, and higher cost of the printing device 7 can be prevented.

Moreover, the alignment section 65 can switch between an alignment state for photographing the alignment marks M, and a nozzle dropout testing state for photographing the ink landing face of the test sheet 91.

Consequently, it is unnecessary to provide a plurality of alignment cameras 61, and alignment of the semiconductor substrates 1 and nozzle dropout testing can be performed with a single camera, to thereby realize a multifunctional printing device 7 having fewer parts as well, so that the device configuration can be smaller and cheaper.

The above description was given with regard to a preferred embodiment according to the present invention with reference to the accompanying drawings, but it will be appreciated that the present invention is not limited to the example. The various shapes, combinations, and the like of each of the illustrated constituent members have been described by way of example, and various different modifications are possible, based on design requirements and the like, within a scope that does not depart from the essence of the present invention.

Figure 11:
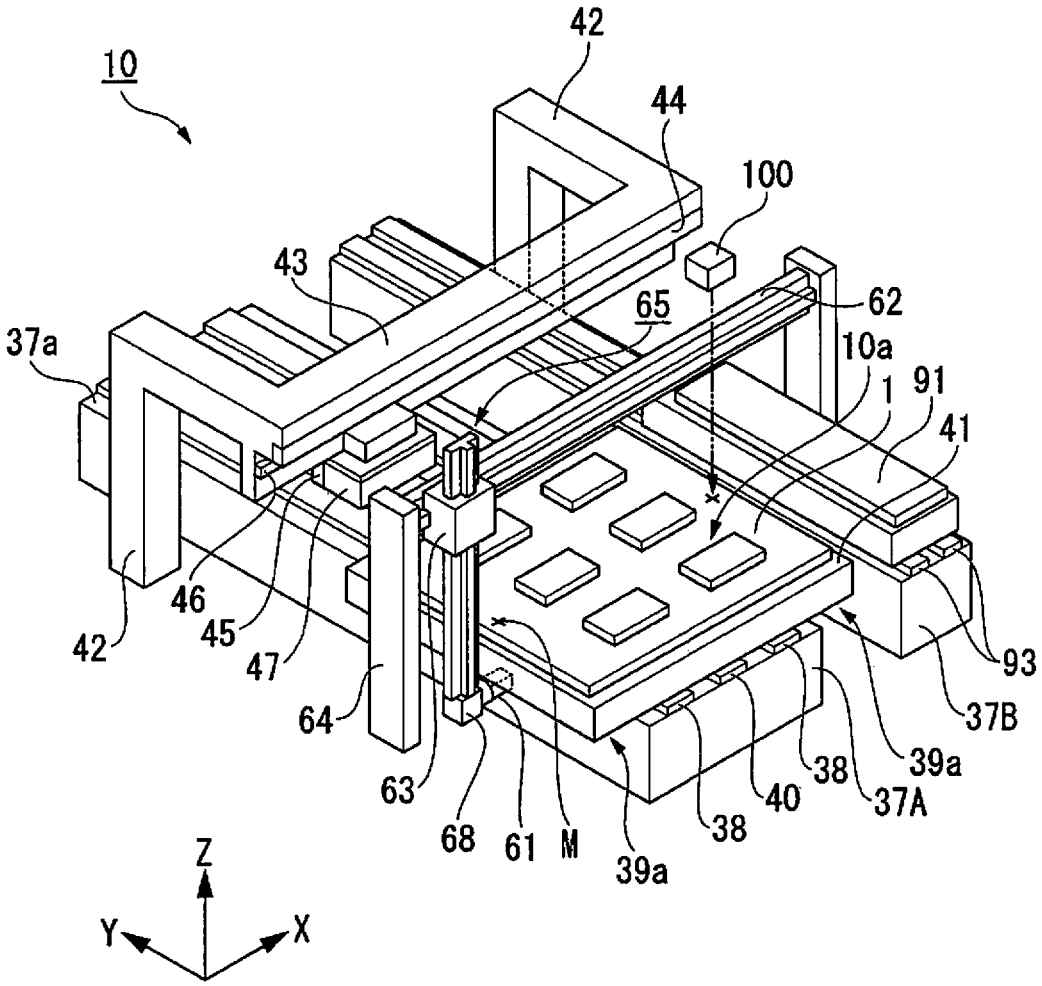
FIG. 11 is a view showing a configuration according to a modification example of the alignment section.

For example, whereas the preceding embodiment described a case in which the alignment section 65 is driven subsequent to recognition by the controller 14, based on information input from the input section 19, of which face has been furnished with alignment marks M, it would also be acceptable to have a sensor (identifier section) 100 provided separately from the alignment camera 61 as shown in FIG. 11 discriminate which face of the semiconductor substrate 1 is furnished with alignment marks M, and to then transmit the identification result to the controller 14 which is electrically connected to the sensor 100. For example, the sensor 100 may monitor alignment mark M formation areas of the semiconductor substrate 1 from one planar side of the stage 39, and in a case which it has discriminated alignment marks, to discriminate that the alignment marks are furnished to a predetermined side, or in a case in which it has not discriminated alignment marks, to discriminate that the alignment marks are furnished to the opposite planar side. According to this configuration, as in the aforedescribed embodiment, the position of the alignment camera 61 can be reliably switched to an optimum position in response to the identification result of the sensor 100. Moreover, whereas the preceding embodiment described a case in which nozzle dropout testing is performed by photographing the ink landing face of the test sheet 91 with the alignment camera 61, a nozzle testing area could be furnished on the semiconductor substrate 1 in place of the test sheet 91. Specifically, a configuration whereby ink droplets are made to land on a portion of the upper face of the semiconductor substrate 1, and nozzle dropout testing is performed by photographing the ink landing face with the alignment camera 61, is acceptable as well.

Additionally, the controller 14 may drive the alignment section 65 in a state of non-recognition as to which face of the semiconductor substrate 1 has been furnished with the alignment marks M. In this case, the controller 14 positions the rotating section 68 to the upper face side of the semiconductor substrate 1, as well as facing the photographing face 61*a* of the alignment camera 61 towards the stage 39, and photographs the semiconductor substrate 1 from the +Z direction side. Meanwhile, in a case in which the alignment camera 61 was not able to discriminate the alignment marks M, the controller 14 positions the rotating section 68 to the lower face side of the semiconductor substrate 1, as well as facing the photographing face 61*a* of the alignment camera 61 towards the stage 39, and photographs the semiconductor substrate 1 from the −Z direction side.

In this way, based on the position of the alignment camera 61 when the alignment camera 61 has discriminated the alignment marks M, the controller 14 can make a determination as to which face of the semiconductor substrate 1 the alignment marks M are disposed on. According to this configuration, as in the aforedescribed embodiment, the determination as to which face of the semiconductor substrate 1 is furnished with the alignment marks M can be made employing the alignment section 65 only.

For example, although an ultraviolet curing ink is used in the above embodiment as UV ink, the present invention is not limited thereto; it is also possible to use various other active light curing inks for which visible light or infrared light can be used as the curing light.

Similarly with respect to the light source, it is possible to use various different active light sources for illuminating with visible light or other active light, i.e., to use an active light source irradiation section.

Herein, the "active light" in the present invention broadly includes, but is not particularly limited to, α-rays, γ-rays, X-rays, ultraviolet rays, visible rays, electron rays, and the like, provided that an energy capable of generating an initiating species in an ink can be imparted as a result of irradiation by the light. Ultraviolet rays and electron rays are preferred among these types of radiation in terms of curing sensitivity and device procurement; ultraviolet rays are particularly preferable. Accordingly, as in the present embodiment, an ultraviolet curing ink, which can be cured by being irradiated with ultraviolet light, is preferably used as the active light curing ink.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

a stage configured and arranged to support a substrate onto which droplets of liquid are ejected from nozzles of an ejection head;

a camera configured and arranged to photograph an alignment mark furnished to one of a first face and a second face of the substrate; and a camera position control mechanism configured and arranged to control a position of the camera to switch between a first state in which the alignment mark is photographed from a side of the first face, and a second state in which the alignment mark is photographed from a side of the second face.

2. The printing device according to claim 1, wherein the stage includes a through-hole formed in an area in which the substrate rests on the stage such that the alignment mark furnished on the second face faces an inner side of the through-hole.

3. The printing device according to claim 1, further comprising an input section configured and arranged to input information indicating which of the first and second faces of the substrate is furnished with the alignment mark, the camera position control mechanism being configured and arranged to switch the position of the camera in response to input of the input section.

4. The printing device according to claim 1, further comprising an identifier section configured and arranged to identify which of the first and second faces of the substrate is furnished with the alignment mark, the camera position control mechanism being configured and arranged to switch the position of the camera in response to an identification result of the identifier section.

5. The printing device according to claim 1, wherein the camera position control mechanism is configured and arranged to photograph with the camera in one of the first state and the second state, and to switch the position of the camera to the other of the first state and the second state and to photograph with the camera when the alignment mark furnished to the substrate cannot be photographed in the one of the first state and the second state.

* * * * *